US006313749B1

(12) United States Patent
Horne et al.

(10) Patent No.: US 6,313,749 B1
(45) Date of Patent: Nov. 6, 2001

(54) SLEEPINESS DETECTION FOR VEHICLE DRIVER OR MACHINE OPERATOR

(76) Inventors: James Anthony Horne; Louise Ann Reyner, both of 14 Paterson Drive, Woodhouse Eaves, Loughborough, Leicestershire LE12 8RL (GB)

( * ) Notice: Subject to any disclaimer, the term of this patent is extended or adjusted under 35 U.S.C. 154(b) by 0 days.

(21) Appl. No.: 09/341,093

(22) PCT Filed: Jan. 5, 1998

(86) PCT No.: PCT/GB98/00015

§ 371 Date: Aug. 24, 1999

§ 102(e) Date: Aug. 24, 1999

(87) PCT Pub. No.: WO98/29847

PCT Pub. Date: Jul. 9, 1998

(30) Foreign Application Priority Data

Jan. 4, 1997 (GB) ..... 9700090

(51) Int. Cl.[7] ..... G08B 23/00
(52) U.S. Cl. ..... 340/575; 340/576
(58) Field of Search ..... 340/575, 576, 340/584, 600, 521, 522

(56) References Cited

U.S. PATENT DOCUMENTS

| | | | | |
|---|---|---|---|---|
| 4,297,685 | * | 10/1981 | Brainard et al. | 340/575 |
| 5,465,079 | * | 11/1995 | Bouchard et al. | 340/576 |
| 5,574,641 | * | 11/1996 | Kawakami et al. | 340/576 X |
| 5,813,989 | * | 9/1998 | Saitoh et al. | 340/576 X |

FOREIGN PATENT DOCUMENTS

| | | |
|---|---|---|
| 44 00 207 | 7/1994 | (DE) . |
| 0 713 675 | 5/1996 | (EP) . |
| WO 95/05649 | 2/1995 | (WO) . |

* cited by examiner

*Primary Examiner*—Thomas Mullen
(74) *Attorney, Agent, or Firm*—Young & Thompson

(57) ABSTRACT

A vehicle driver or machine operator sleepiness monitor, configured as a self-contained module, for steering wheel or dashboard mounting, provides for individual driver/operator interrogation and response, combined with various objective sensory inputs on vehicle condition and driver control action, and translates these inputs into weighing factors to adjust a biological activity circadian rhythm reference model, in turn to provide an audio-visual sleepiness warning indication.

9 Claims, 18 Drawing Sheets

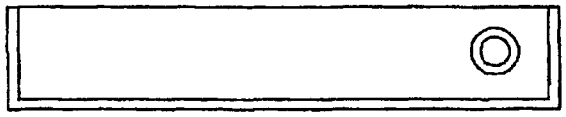
Rear panel
Figure 13D
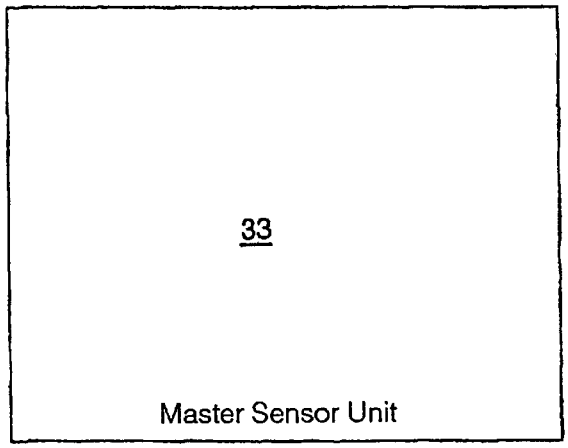
Top View
Figure 13C
Side view
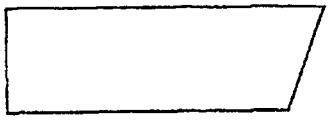
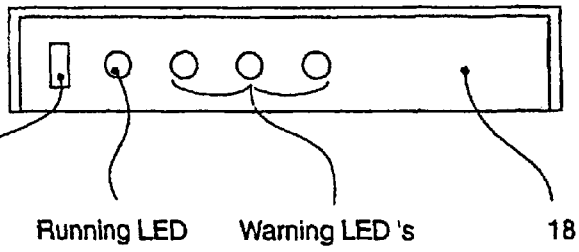
Figure 13B
Figure 13A

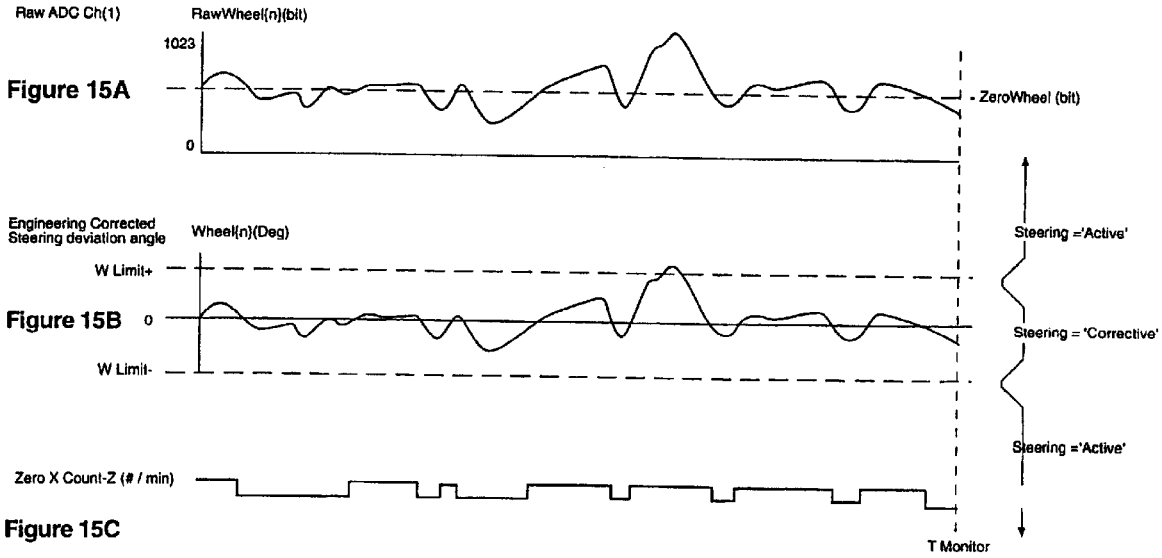
Figure 15A
Figure 15B
Figure 15C
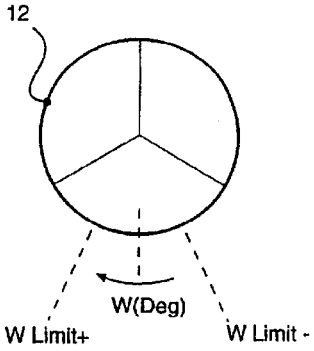
Figure 15D

SLEEPINESS DETECTION FOR VEHICLE DRIVER OR MACHINE OPERATOR

BACKGROUND OF THE INVENTION

This invention relates to human sleepiness, drowsiness or (lack of) alertness detection and monitoring, to provide a warning indication in relation to the capacity or fitness to drive or operate (moving) machinery.

Although its rationale is not fully understood, it is generally agreed that sleep is a powerful and vital, biological need, which—if ignored—can be more incapacitating than realised, either by a sleepy individual subject, or by those tasking the subject.

As such, the invention is particularly, but not exclusively, concerned with the (automated) recognition of sleepiness and performance-impaired fatigue in drivers of motor vehicles upon the public highway.

Professional drivers of, say, long-haul freight lorries or public transport coaches are especially vulnerable to fatigue, loss of attention and driving impairment.

With this in mind, their working and active driving hours are already carefully monitored to ensure they are within prescribed limits.

Road accidents, some with no apparent external cause, have been attributed to driver fatigue.

Studies, including those by the Applicants themselves, (see the list of references at the end of this disclosure), into sleep-related vehicle accidents have concluded that such accidents are largely dependent on the time of day.

Age may also be a factor—with young adults more likely to have accidents in the early morning, whereas older adults may be more vulnerable in the early afternoon.

Drivers may not recollect having fallen asleep, but may be aware of a precursory sleepy state, as normal sleep does not occur spontaneously without warning.

The present invention addresses sleepiness monitoring, to engender awareness of a state of sleepiness, in turn to prompt safe countermeasures, such as stopping driving and having a nap.

Accidents have also been found to be most frequent on monotonous roads, such as motorways and other main roads.

Indeed, as many as 20–25% of motorway accidents seem to be as a result of drivers falling asleep at the wheel.

Although certain studies concluded that it is almost impossible to fall asleep while driving without any warning whatsoever, drivers frequently persevere with their driving when they are sleepy and should stop.

Various driver monitoring devices, such as eyelid movement detectors, have been proposed to assess fatigue, but the underlying principles are not well-founded or properly understood.

Sleepiness in the context of driving is problematic, because the behavioural and psychological processes which accompany falling asleep at the wheel may not typify the characteristics of sleep onset commonly reported under test conditions and simulations by sleep laboratories.

Driving will tend to make a driver put considerable effort into remaining awake, and in doing so, the driver will exhibit different durations and sequences of psychological and behavioural events that precede sleep onset.

As underlying sleepiness may be masked by this prefacing compensatory effort, the criteria for determining whether a subject is falling asleep may be unclear.

Indeed, the Applicants have determined by practical investigation that parameters usually accepted to indicate falling asleep are actually not reliable as an index of sleepiness if the subject is driving.

For example, although in general eye blink rate has a tendency to rise with increasing sleepiness, this rate of change is confounded by the demand, variety and so stimulus content or level of a task undertaken (eg driving), there being a negative correlation between blink rate and task difficulty.

In an attempt to prevent sleep-related vehicle accidents, it is also known passively to monitor driver working times through chronological activity logs, such as tachographs. However, these provide no active warning indication.

More generally, it is also known to monitor a whole range of machine and human factors for vehicle engineering development purposes, some merely for historic data accumulation, and other unsatisfactory attempts at 'real-time' active warning.

The Applicants are not aware of any practical implementation hitherto of sleepiness detection, using relevant and proven biological factors addressing inherent body condition and capacity.

Studies and trials carried out by the Applicants have shown that there are clear discernible peaks of sleep-related vehicle accidents in the UK around 02.00–06.00 hours and 14.00–16.00 hours.

Similar time-of-day data for such accidents have been reported for the USA, Israel and Finland.

These sleep-related vehicle accident peaks are distinct from the peak times for all road traffic accidents in the UK—which are around the main commuting times of 08.00 hours and 17.00 hours.

The term 'sleepiness' is used herein to embrace essentially pre-sleep conditions, rather than sleep detection itself, since, once allowed to fall asleep, it may be too late to provide useful accident avoidance warning indication or correction.

Generally, a condition or state of sleepiness dictates a lessened awareness of surroundings and events a reduced capacity to react appropriately; and an extended reaction time.

It is known from sleep research studies that the normal human body biological or physiological activity varies with the time of day, over a 24 hour, (night-day-night) cycle—in a characteristic regular pattern, identified as the circadian rhythm, biorhythm or body clock.

The human body thus has a certain predisposition to drowsiness or sleep at certain periods during the day—especially in early morning hours and mid afternoon.

This is exacerbated by metabolic factors, in particular consumption of alcohol, rather than necessarily food per se.

SUMMARY OF THE INVENTION

According to one aspect of the invention a monitor taking account of circadian and sleep parameters of an individual vehicle driver, and/or generic or universal human physiological factors, applicable to a whole class or category of drivers, is integrated with 'real-time' behavioural sensing, such as of road condition and driver control action, including steering and acceleration, to provide an (audio-) visual indication of sleepiness.

For safety and legislative reasons, it is not envisaged that, at least in the immediate future, an alert condition would necessarily be allowed automatically to override driver control—say by progressively disabling or disengaging the vehicle accelerator.

Rather, it would remain a driver's responsibility to respond constructively to an alert issued by the system—which could log the issue of such warnings for future reference in assessing compliance.

Overall system capability could include one or more of such factors as:

common, if not universal, underlying patterns or sleepiness (pre-conditioning);

exacerbating personal factors for a particular user—driver, such as recent sleep patterns especially, recent sleep deprivation and/or disruption;

with a weighting according to other factors, such as the current time of day.

Thus background circumstances, in particular a natural alertness 'low point'—and attendant sleepiness or susceptibility to (unprompted) sleep—in the natural physiological biorhythmic or circadian cycle may pre-dispose a driver to sleepiness, exacerbated by sleep deprivation in a recent normal sleep period.

If not circadian rhythm patterns themselves, at: least the ability of the body behaviour and activity to respond to the underlying pre-disposition or pre-condition, may be disturbed or frustrated by abnormal or changing shift: patterns, prefaced by inadequate acclimatisation.

Thus, for example, in exercising vehicle control, aberrant driver steering behaviour, associated with degrees of driver sleepiness, could be recognised and corrected—or at: least a warning issued of the need for correction (by sleep restitution).

Pragmatically, any sleepiness warning indication should be of a kind and in sufficient time to trigger corrective action.

According to another aspect of the invention, a driver sleepiness, alertness or fitness condition monitor comprises a plurality of sensory inputs, variously and respectively related to, vehicle motion and steering direction, circadian or biorhythmic physiological patterns, recent driver experiences and preconditioning;

such inputs being individually weighted, according to contributory importance, and combined in a computational decision algorithm or model, to provide a warning indication of sleepiness.

Some embodiments of the invention can take into account actual, or real-time, vehicle driving actions, such as use of steering and accelerator, and integrate them with inherent biological factors and current personal data, for example recent sleep pattern, age, sex, recent alcohol consumption (within the legal limit), reliant upon input by a driver being monitored.

Steering action or performance is best assessed when driving along a relatively straight road, such as a trunk, arterial road or motorway, when steering inputs of an alert driver are characterised by frequent, minor correction.

In this regard, certain roads have characteristics, such as prolonged 'straightness' and monotonous contouring or landscaping, which are known to engender or accentuate driver sleepiness.

It is envisaged that embodiments of the steering detector will also be able to recognise when a vehicle is on such (typically straighter) roads.

Some means, either automatically through a steering sensor, or even from manual input by the driver, is desirable for motorway as opposed to, say, town driving conditions, where large steering movements obscure steering irregularities or inconsistencies.

Indeed the very act of frequent steering tends to contribute to, or stimulate, wakefulness. Yet a countervailing tendency to inconsistent or erratic steering input may prevail, which when recognised can signal an underlying sleepiness tendency.

In practice, having recognised the onset of journeys on roads with an enhanced sleepiness risk factor, journey times on such roads beyond a prescribed threshold—say 10 minutes—could trigger a steering action detection mode, with a comparative test against a steering characteristic algorithm, to detect sleepy-type driving, and issue a warning indication in good time for corrective action.

As another vehicle control condition indicator, accelerator action, such as steadiness of depression, is differently assessed for cars than lorries, because of the different spring return action.

Implementation of semi-automated controls, such as cruise-controls, with constant speed setting capabilities, could be disabled temporarily for sleepiness monitoring.

In assessing driver responses to pre-programmed device interrogation, reliance is necessarily placed upon the good intentions, frankness and honesty of the individual.

A practical device would embody a visual and/or auditory display to relay warning messages and instructions to and responses from the user.

Similarly, interfaces for vehicle condition sensors, such as those monitoring steering and accelerator use, would be incorporated.

Furthermore, input (push-button) switches for driver responses could also be featured—conveniently adjacent the visual display.

Input effort would be minimal to encourage participation, and questions would be straightforward and direct, to encourage explicit answers.

Visual display reinforcement messages could be combined with the auditory output.

Ancillary factors, such as driver age and sex, could also be input.

An interface with a global positioning receiver and map database could also be envisaged, so that the sleepiness indicator could register automatically roads with particular characteristics, including a poor accident record, and adjust the monitoring criteria and output warning display accordingly.

The device could be, say, dashboard or steering wheel mounted, for accessibility and readability to the driver.

Ambient external light conditions could be sensed by a photocell. Attention could thus be paid at night to road lighting conditions.

Vehicle driving cab temperature could have a profound effect upon sleepiness, and again could be monitored by a localised transducer at the driver station.

The device could categorise sleepiness to an arbitrary scale. Thus, for example, the following condition levels could be allocated:

ALERT
A LITTLE SLEEPY
NOTICEABLY SLEEPY
DIFFICULTY IN STAYING AWAKE
FIGHTING SLEEP
WILL FALL ASLEEP

Personal questions could include:

QUANTITY OF SLEEP IN THE LAST 24 HOURS
QUALITY OF THAT SLEEP IN THE LAST 24 HOURS

Road conditions could include:

MOTORWAY
MONOTONOUS
TOWN

Night-time with no street lights could be given a blanket impairment rating or loading.

Assumptions are initially made of no alcohol consumption whatsoever (ie legal limits disregarded).

A circadian rhythm model allows a likelihood of falling asleep, or a sleep propensity, categorised between levels 1 and 4—where 4 represents very likely and 1 represents unlikely.

The lowest likelihood of sleepiness occurs from mid morning to early afternoon.

Thereafter a mid afternoon lull, or rise in likelihood of sleepiness to 3 is followed by another trough of 1 in early evening, rising stepwise towards late night, through midnight and into the early hours of the morning.

BRIEF DESCRIPTION OF THE PREFERRED EMBODIMENTS

There now follows a description of some particular embodiments of the invention, by way of example only, with reference to the accompanying diagrammatic and schematic drawings, in which.

Figure 10:
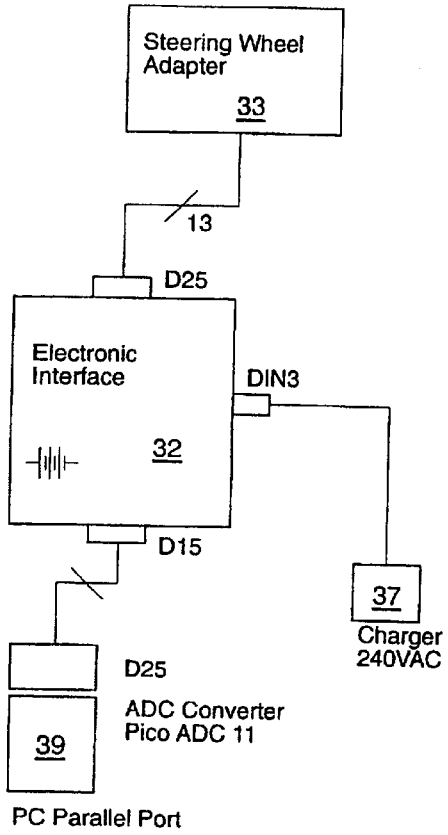
Figure 11:
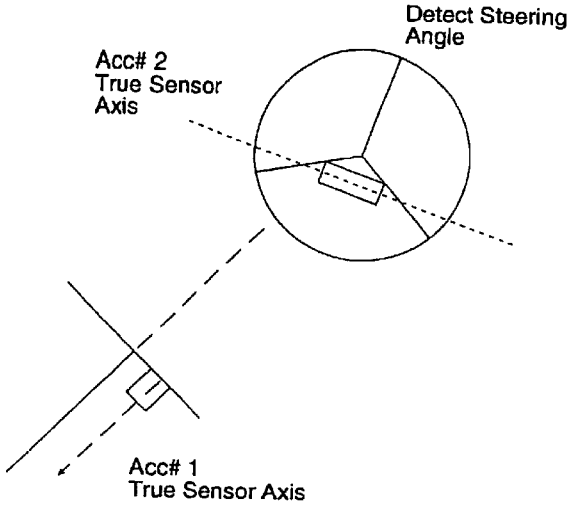
Figure 12:
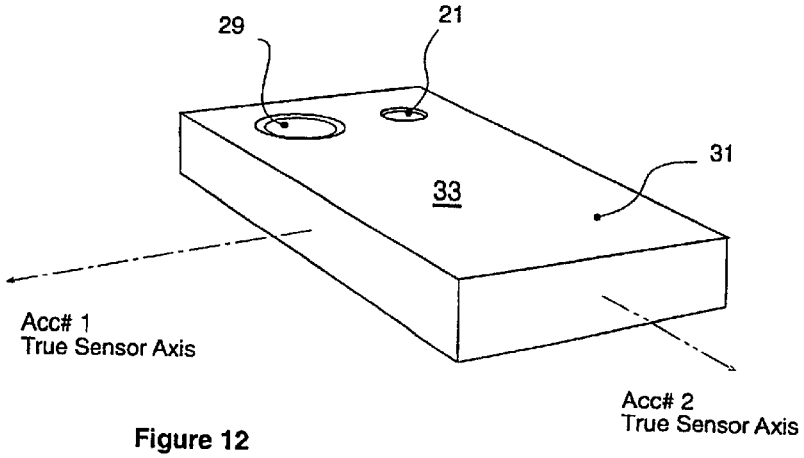
Figure 14A:
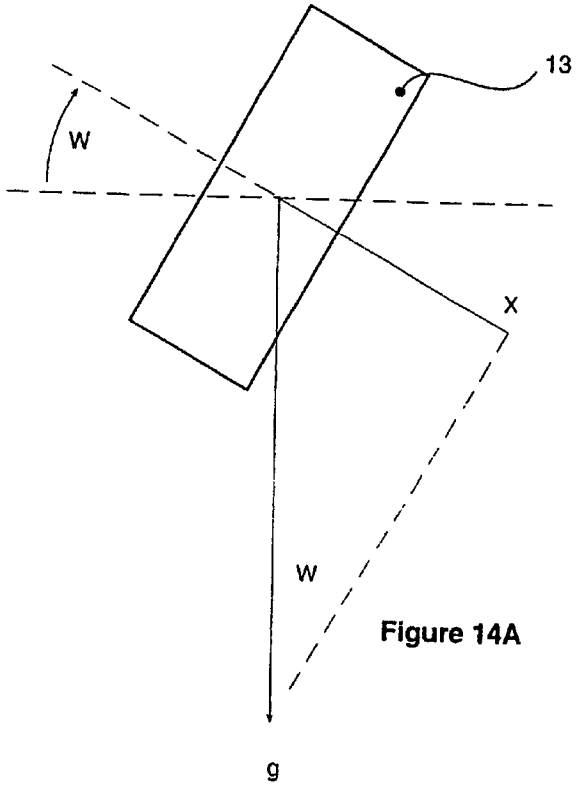
Figure 14B:
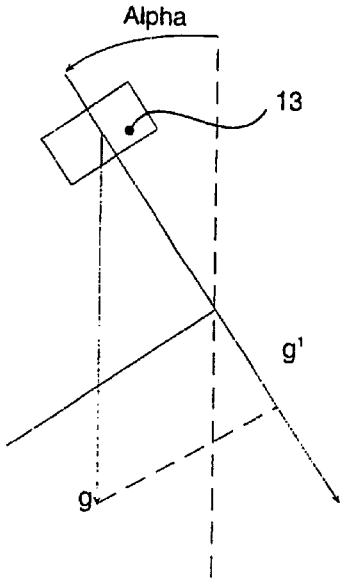
Figures 16A, 16B:
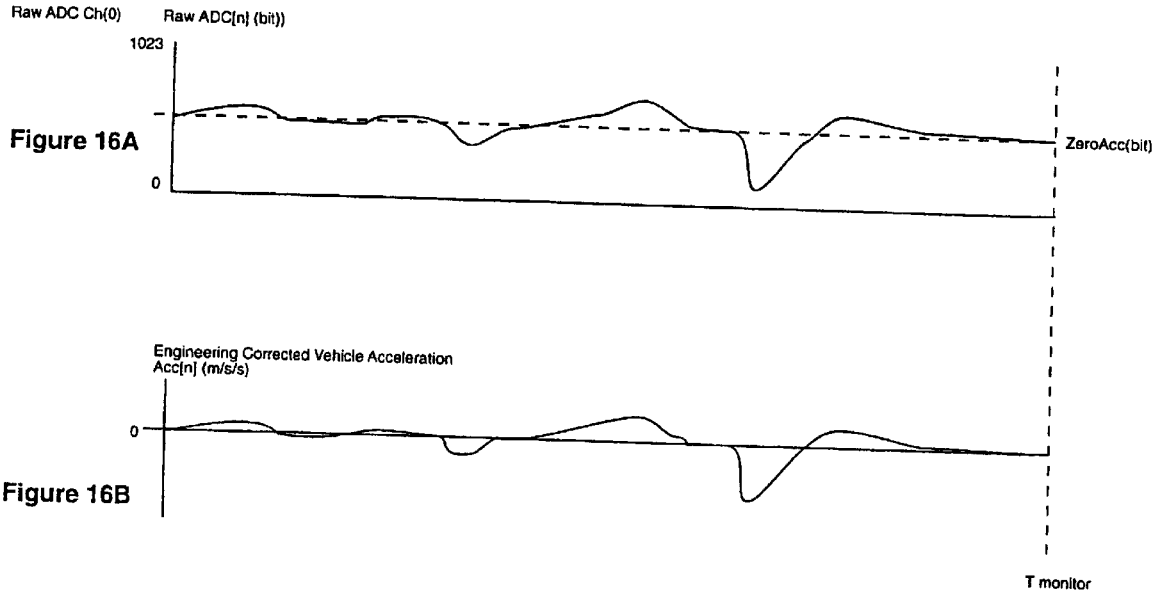
Figure 17:
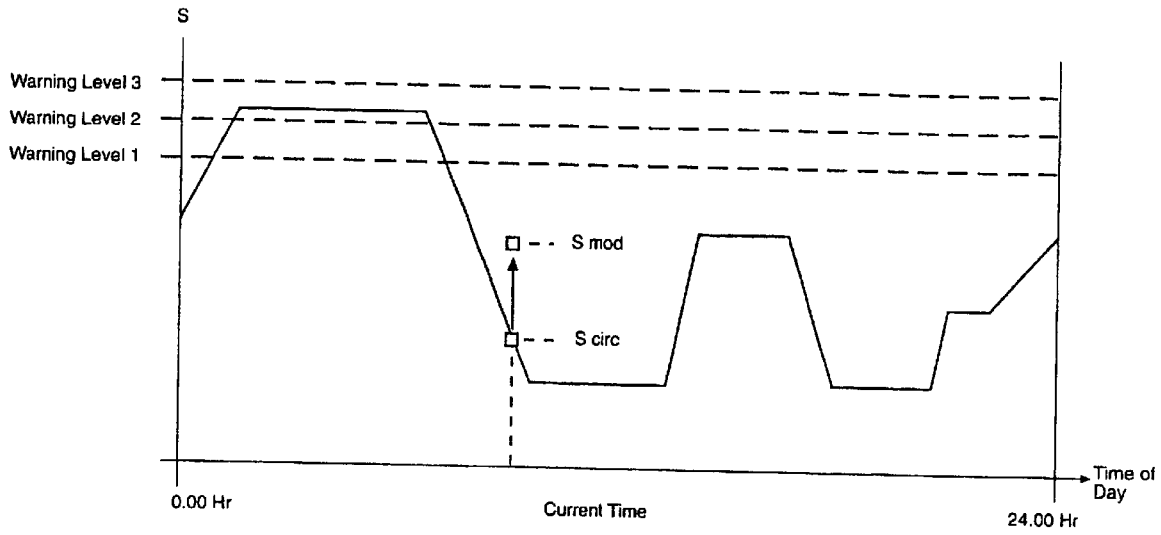
Figure 18:
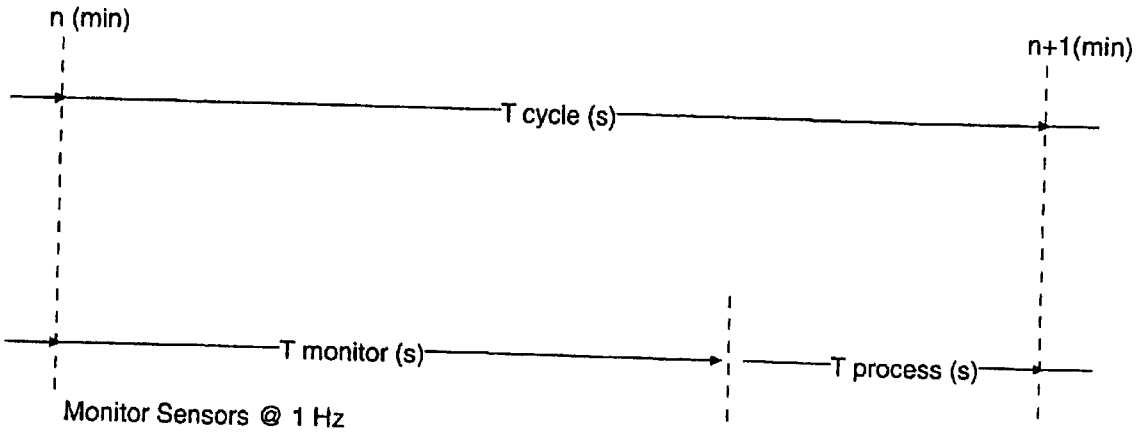
Figure 19:
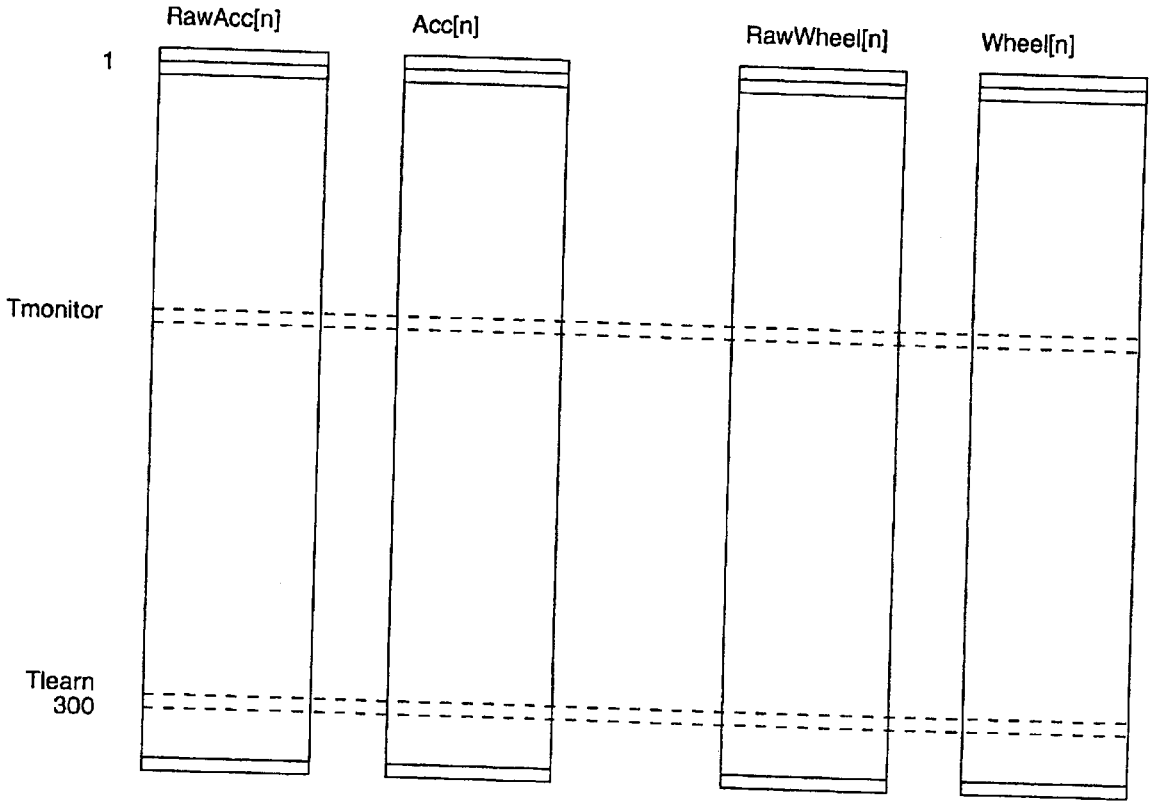
Figure 20:
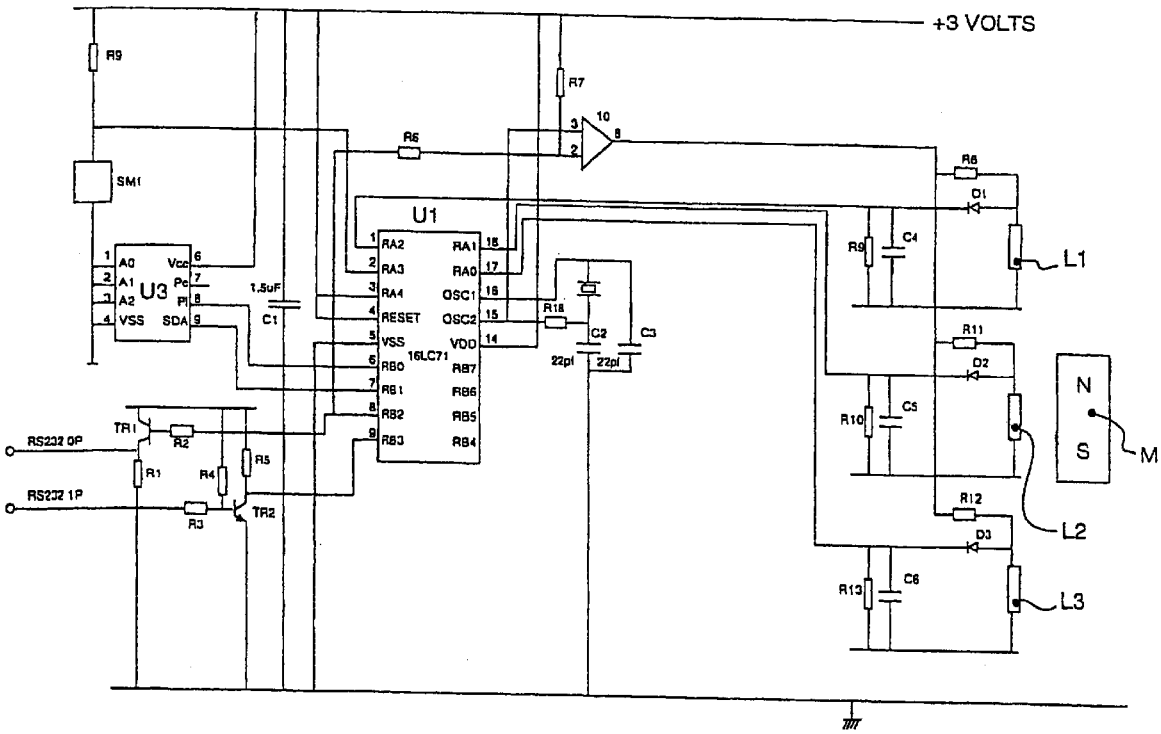
Figure 21:
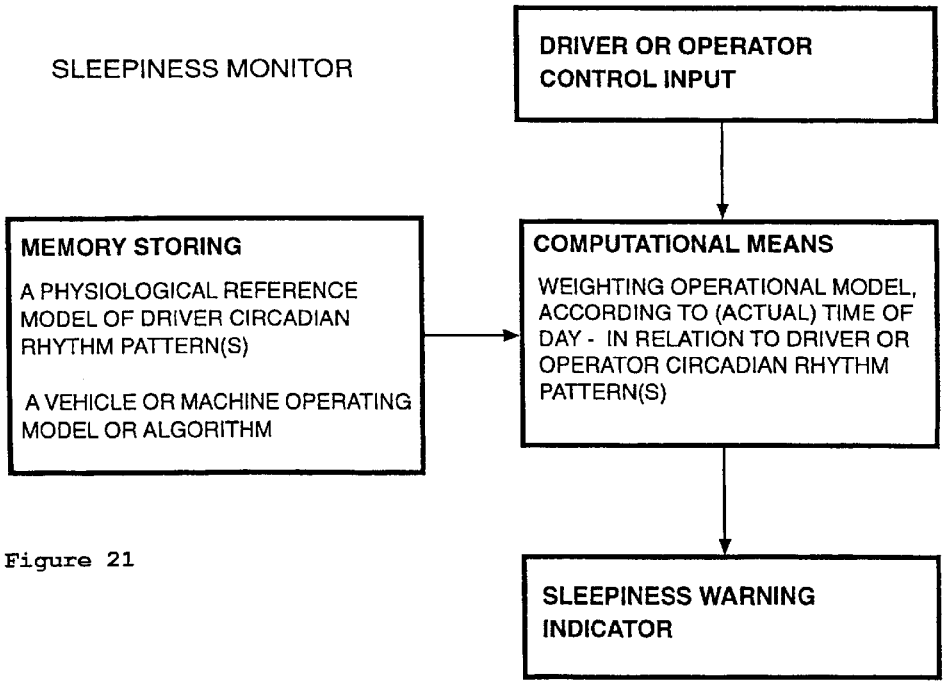

FIGS. 4 and 5, 6 and 7, 8 and 9 show paired personal performance graphs reflecting steering wheel inputs for three individual drivers, each pair representing comparative alert and sleepy (simulated) driving conditions;

FIG. 10 shows principal elements of a driver monitor system, with an integrated multi-mode sensing module;

FIG. 11 shows a sensing arrangement for motion and steering, in relation to respective reference or datum axes, for the multi-mode sensing module of FIGS. 10 and 12 (see legend in Table 1);

FIG. 12 shows the multi-mode sensor of FIG. 10 in more detail;

FIGS. 13A through 13D show a variant housing for the multi-mode sensor of FIGS. 10 and 12;

FIGS. 14A and 14B show steering wheel dynamic sensing geometry (see legend in Table 2);

FIGS. 15A through 15D show steering wheel movement and attendant correction (see legend in Tables 3–4);

FIGS. 16A and 16B show vehicle acceleration and correction (see legend in Table 5);

FIG. 17 shows periodic variation of sleepiness/alertness and attendant warning threshold levels (see legend in Tables 10–11);

FIG. 18 shows the sub-division of system operational time cycles (see legend in Table 6);

FIG. 19 shows system data storage or accumulation for computation (see legend in Tables 7–8);

FIG. 20 shows a circuit diagram of a particular multi-mode sensor, with a magnetic-inductive flux coupling sensing of rate of change of steering wheel movement; and FIG. 21 is a flow chart depicting communication among various system components.

DESCRIPTION OF THE PREFERRED EMBODIMENTS

Figure 1:
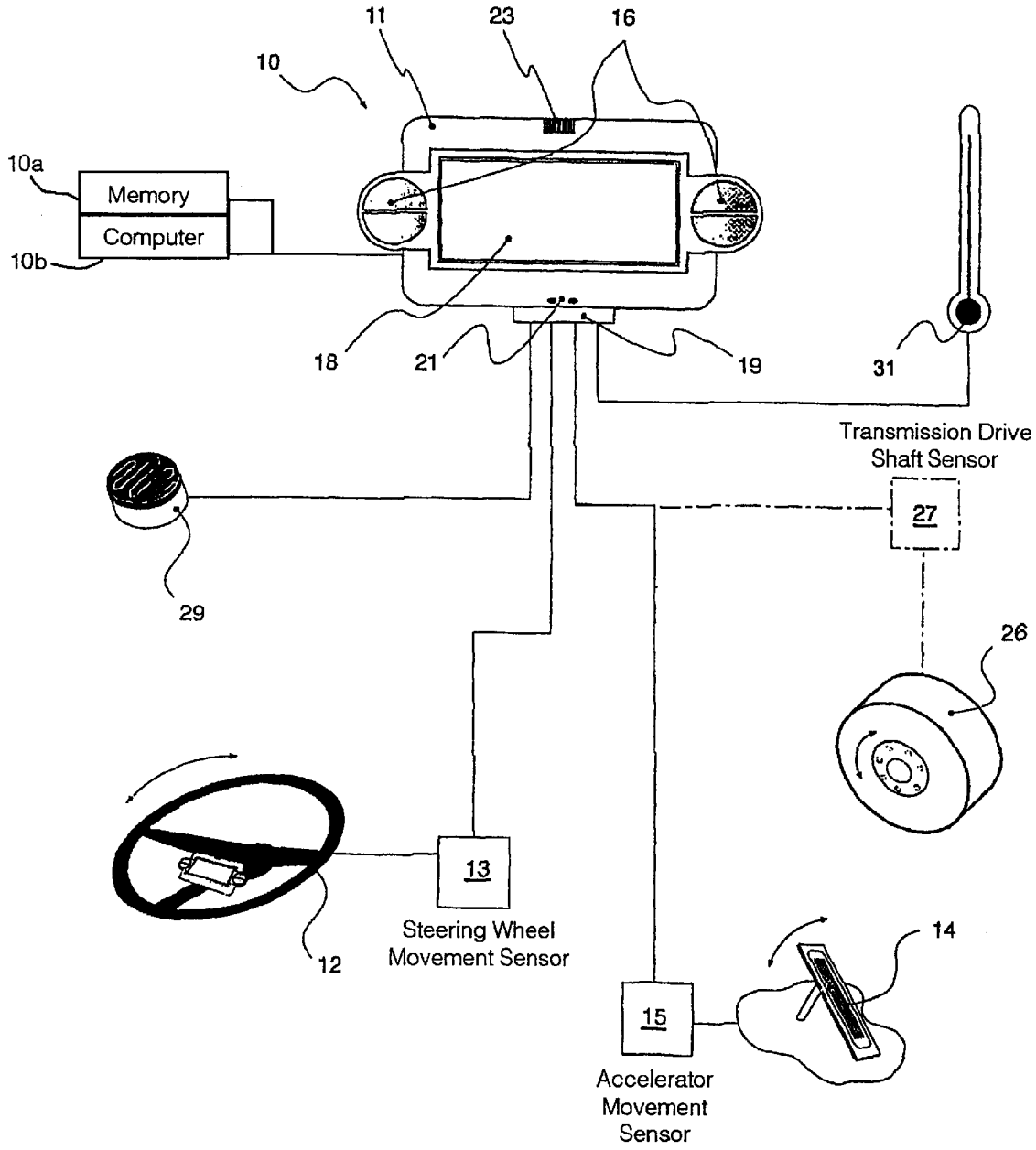
FIG. 1 shows the circuit layout of principal elements in a sleepiness monitor for a road vehicle driver.
Figure 2:
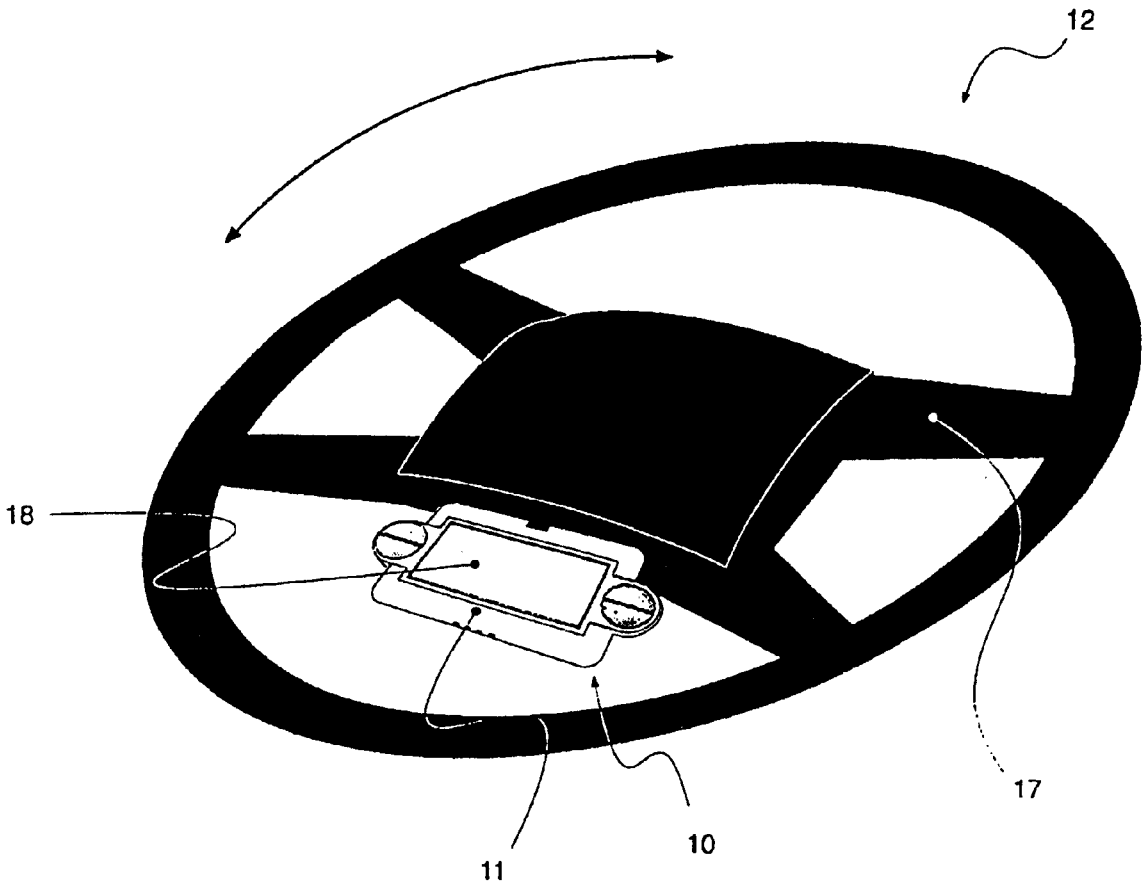
FIG. 2 show an installation variant for the indicator and control unit of the sleepiness monitor shown in FIG. 1.

Referring to FIG. 1, a sleepiness monitor 10 is integrated within a housing 11, configured for ease of in-vehicle installation, for example as a dashboard mounting, or, as depicted in FIG. 2, mounted on the steering wheel 12 itself. The monitor 10 may include a memory 10*a* and computer 10*b*.

In a preferred variant, the monitor 10 could be self-contained, with an internal battery power supply and all the necessary sensors fitted internally, to allow the device to be personal to a driver and moved with the driver from one vehicle to another.

An interface 19, for example a multi-way proprietary plug-and-socket connector, is provided in the housing, to allow interconnection with an additional external vehicle battery power supply and various sensors monitoring certain vehicle conditions and attendant driver control action.

Thus a steering wheel movement sensor 13 monitors steering inputs from a driver (not shown) to steering wheel 12.

The sensor 13 could be located within the steering wheel 12 and column assembly.

More sophisticated integrated multi-channel, remote sensing is described later in relation to FIGS. 11 and 12.

Similarly, an accelerator movement sensor 15 monitors driver inputs to an accelerator pedal 14.

Alternatively, and again in a more sophisticated sensor variant, a dynamic accelerometer could be employed, as in FIGS. 11 and 12.

The sensor 15 could be an accelerometer located within the housing 11 in a self-contained variant. Care is taken to obviate the adverse effects of vehicle vibration upon dynamic sensory measurements.

Albeit, somewhat less conveniently, vehicle motion and acceleration could be recognised through a transmission drive shaft sensor 27, coupled to a vehicle road wheel 26 or by interfacing with existing sensors or control processors for other purposes, such as engine and transmission management.

The trend to multiplex vehicle electrical supply systems, relaying data between vehicle operational modules, may facilitate such interconnection.

More sophisticated sensors, with an ability for remote self-contained condition sensing, data accumulation and data transfer, data down-loading or data up-loading may be employed.

Thus, for example, a steering wheel movement sensor module, the version of FIG. 20, may rely upon a wireless or contact-free linkage—such as magnetic flux coupling between magnetic elements on the wheel or shaft and an adjacent static inductive or capacitative transducer to register rate of change of wheel movement (as opposed to, say an average RMS computation of FIGS. 15A and 15B).

Such remote sensing and data linkage obviates the need for major vehicle wiring harness alteration or supplement.

Overall, the device could have an internal memory of speed and steering wheel movements and so the basis of a 'performance history' of driver actions as a basis for decision upon issuing warning indication.

The interface 19 would enable data to be down-loaded onto a PC via, say, the PC parallel port or over a radio or infra-red 'wireless' link.

A further photocell sensor 29 monitors ambient light conditions from the driving position and is calibrated to assess both day-night transitions and the presence or absence of street lighting at night.

In the variants 10, 12 and 13A through 13D, multi-mode or multiple (independent) factor sensing is integrated within a common co-called 'steering wheel adaptor' module 33.

Reverting to the unit 10 of FIGS. 1 and 2, the housing 11 incorporates a visual display panel or screen 18, for relaying instructions and warning indications to the user.

A touch-sensitive inter-actional screen could be deployed.

Manual or automated adjustment for screen contrast according to ambient light conditions could be embodied.

The variants of FIGS. 10, 12 and 13A through 13D allow for a simpler devolved display of certain operating criteria, by multiple LED's on a multi-mode sensor module 33.

A loudspeaker 21 can relay reinforcement sound messages, for an integrated audio-visual driver interaction.

Also to that end, in a more sophisticated variant—possibly merely as an ongoing research and development tool, a microphone 23 might be used to record and interpret driver responses, possibly using speech recognition software.

Alternatively, interactive driver interrogation and response can be implemented by a series of push button switches 16 arrayed alongside the screen 18, for the input of individual driver responses to preliminary questions displayed upon the screen 18.

Thus, for example, non-contentious factors, such as driver age and sex may be accounted for, together with more subjective review of recent sleep history.

Questions would be phrased concisely and unequivocally, for ease and immediacy of comprehension and certainty or authenticity of response.

Thus, for example, on the pivotal contributory factor of driver's recent sleep, the question:

'How much sleep have you had in the last 24 hours' could be juxtaposed with a multiple choice on screen answer menu, such as:

Choice of ONE answer . . .

Little or none . . . [generating a weighting score of 2]

Less than normal . . . [score 1]

About the same as normal, undisturbed . . . [score 0]

About the same as normal, but disturbed . . . [score 1]

Other contributory factors include road conditions and vehicle cabin temperature.

Road conditions would be assessed through the steering sensor 13, and through an initial input question upon road conditions.

Thus, a dull, monotonous road would justify a weighting of plus 1 to all the circadian scores.

On the other hand, town driving, promoting greater alertness from external stimuli, would merit a score of minus 1.

Vehicle cabin temperature is taken into account, primarily to register excessively high temperatures which might induce sleepiness.

Driver cab temperatures could be monitored with a temperature sensor probe 31 (located away from any heater output vents).

Thus, for example, a threshold of some 25 degrees C might be set, with temperatures in excess of this level triggering a score of plus 0.5.

In normal operating mode, the monitor relies upon the working assumption that the driver has had little or no recent or material alcohol consumption.

The physiological circadian rhythm 'template' or reference model pre-loaded into the monitor memory is adjusted with the weighting scores indicated.

If the cumulative score is equal to or greater than 3, the steering sensor is actively engaged and checked to determine the road conditions.

Figure 3:
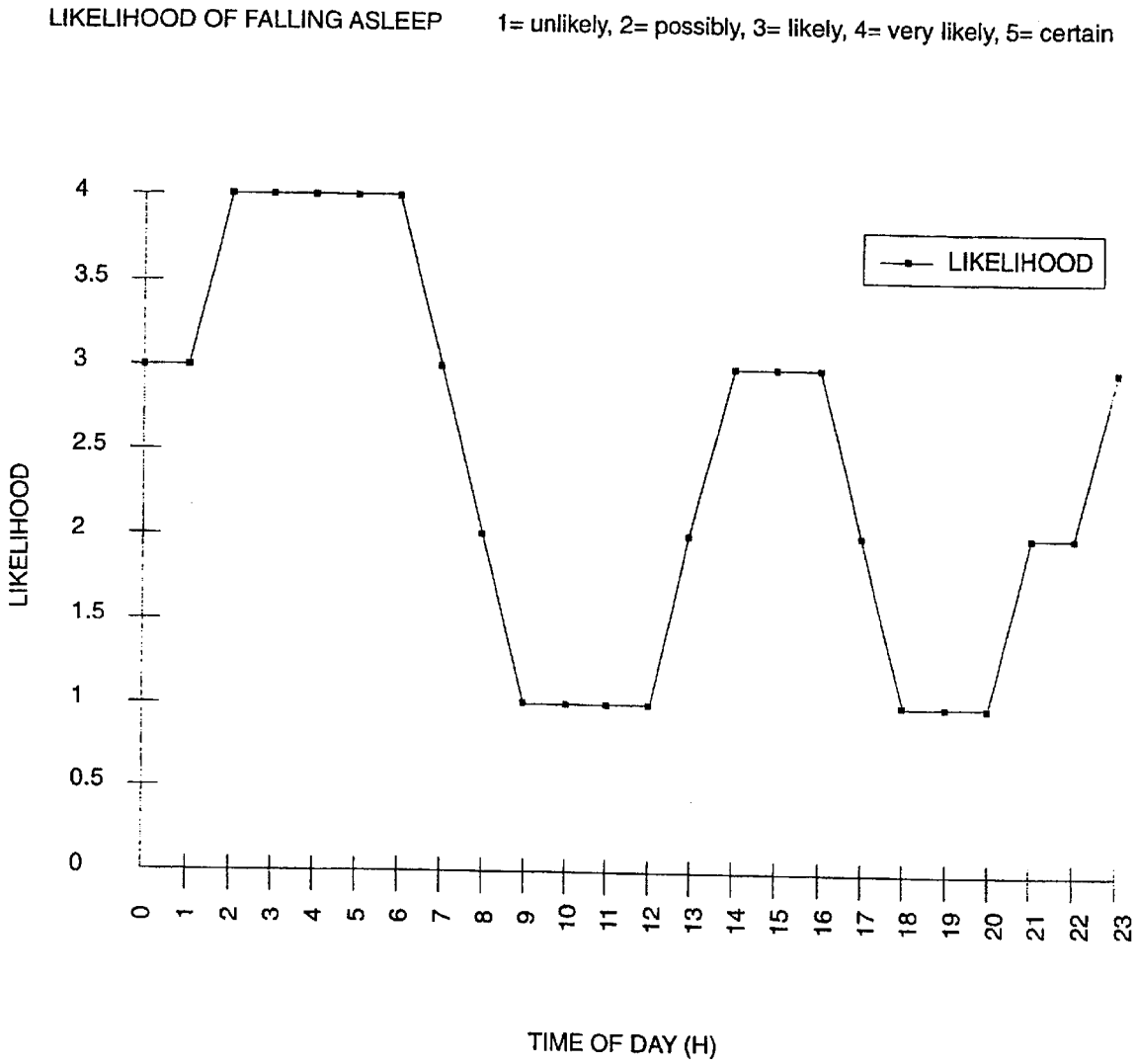
FIG. 3 shows a graphical plot of varying susceptibility to sleepiness over a 24 hour period, reflecting human body circadian rhythm patterns.

The sleepiness scale values, reflected in the unweighted graph of FIG. 3, can broadly be categorised as:

ALERT
NEITHER ALERT NOR SLEEPY
A LITTLE SLEEPY
NOTICEABLY SLEEPY
DIFFICULTY IN STAYING AWAKE
FIGHTING SLEEP
WILL FALL ASLEEP

An internal memory module may store data from the various remote sensors 13, 15, 27, 29, 31—together with models or algorithms of human body circadian rhythms and weighting factors to be applied to individual sensory inputs.

An internal microprocessor is programmed to perform calculations according to driver and sensory inputs and to provide an appropriate (audio-)visual warning indication of sleepiness through the display screen 18.

FIG. 2 shows a steering-wheel mounted variant, in which the housing 11 sits between lower radial spokes 17 on the underside of a steering wheel 12—in a prominent viewing position for the driver, but not obstructing the existing instrumentation, in particular speedometer, nor any air bag fitted.

Ambient temperature and lighting could also be assessed from this steering wheel vantage point.

This location also facilitates registering of steering wheel movement. With an internal accelerometer and battery, external connections could be obviated.

Whilst a motor vehicle orientated monitor has been disclosed in the foregoing example, the operating principles are more widely applicable to moving machine-operator environments, as diverse as cranes, construction site excavators and drilling rigs—possibly subject to further research and development.

FIGS. 4 through 9 show the respective steering 'performances' of three individual subjects, designated by references S1, S2 and S3, under alert and sleepy (simulated) driving conditions.

Each graph comprises two associated plots, representing steering wheel movement in different ways.

Thus, one plot directly expresses deviations of steering wheel position from a straight-ahead reference position—allotted a 'zero' value.

This plot depicts the number of times a steering wheel is turned in either direction, over a given time period— allowing for a ±3% 'wobble' factor as a 'dead' or neutral band about the reference position.

The other plot is an averaged value of steering wheel movement amplitude (ie the extent of movement from the reference position)—using the RMS (root mean squared) of the actual movements.

Generally, the graphs reflect a characteristic steering performance or behaviour.

In particular, as a person becomes sleepy, zero crossings are reduced in frequency, whereas RMS amplitudes increase and/or become more variable.

Figure 4:
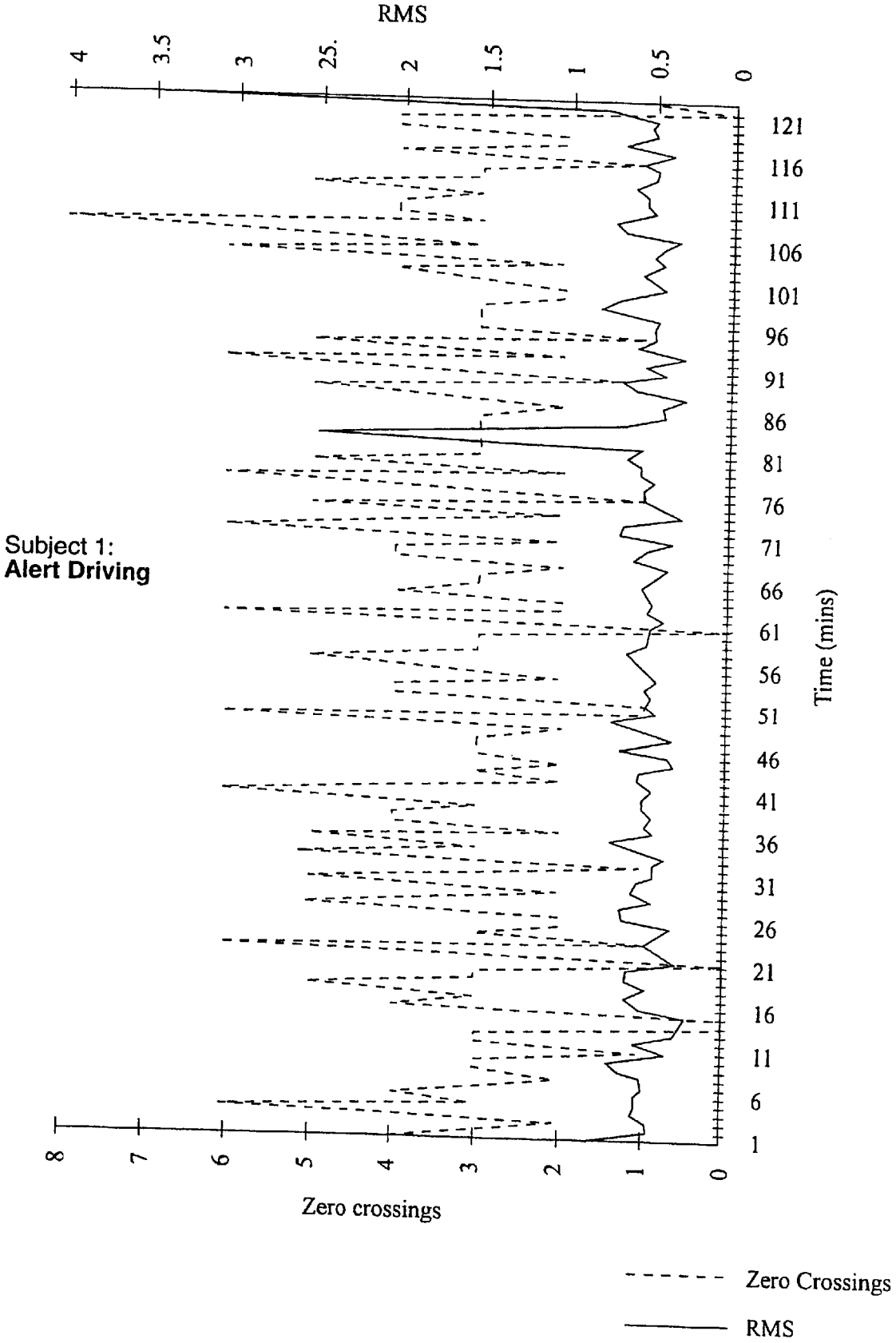

Thus, FIG. 4 reflects steering behaviour of an alert subject S1.

Collectively, the 'zero-crossing' and 'RMS' plots for alert subject S1 reflect a generally continual and consistent steering correction.

Figure 5:
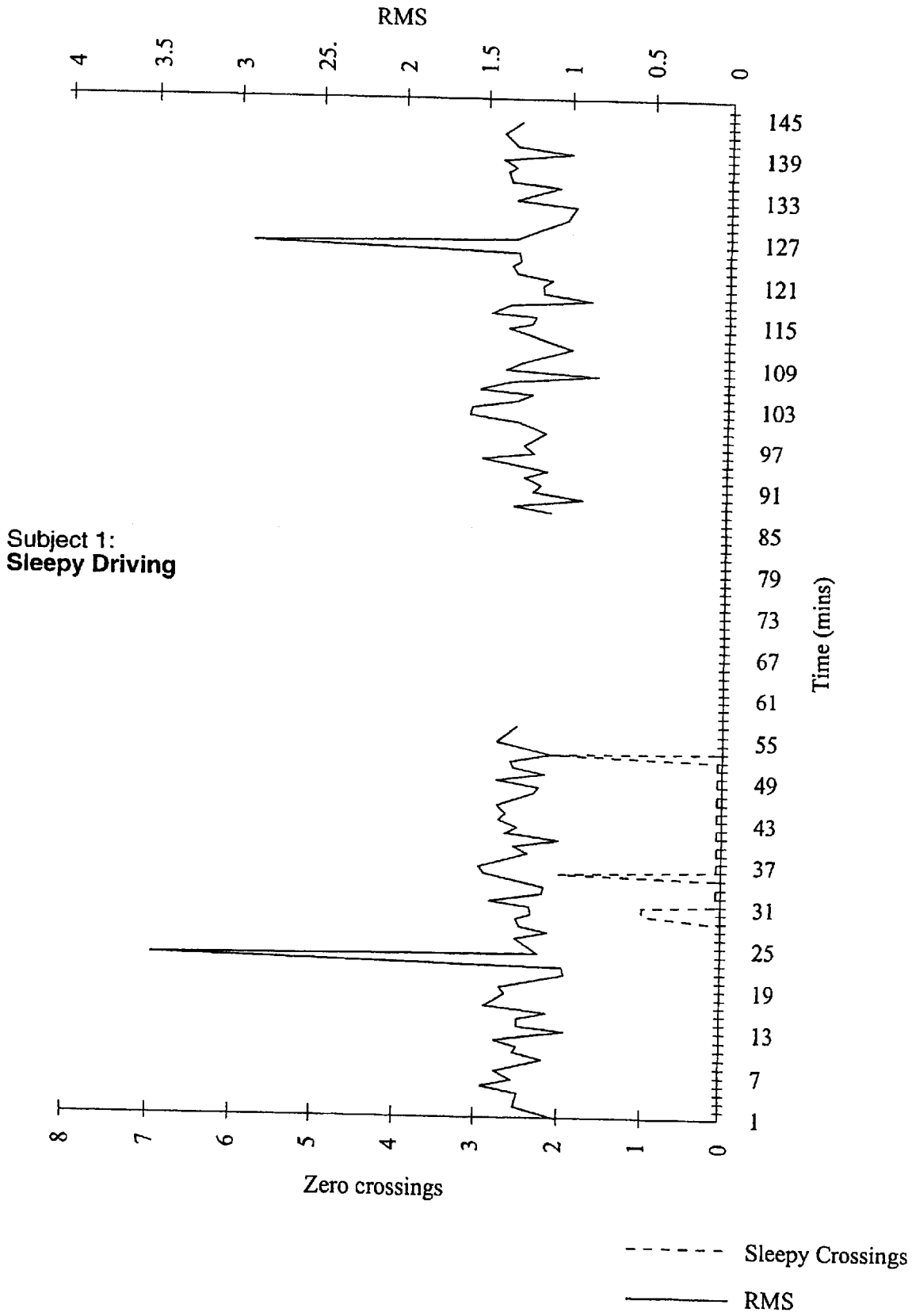

In contrast, the steering behaviour of a sleepy subject S1, reflected in FIG. 5, exhibits less frequent, erratic, exaggerated or excessive steering movement.

Figure 6:
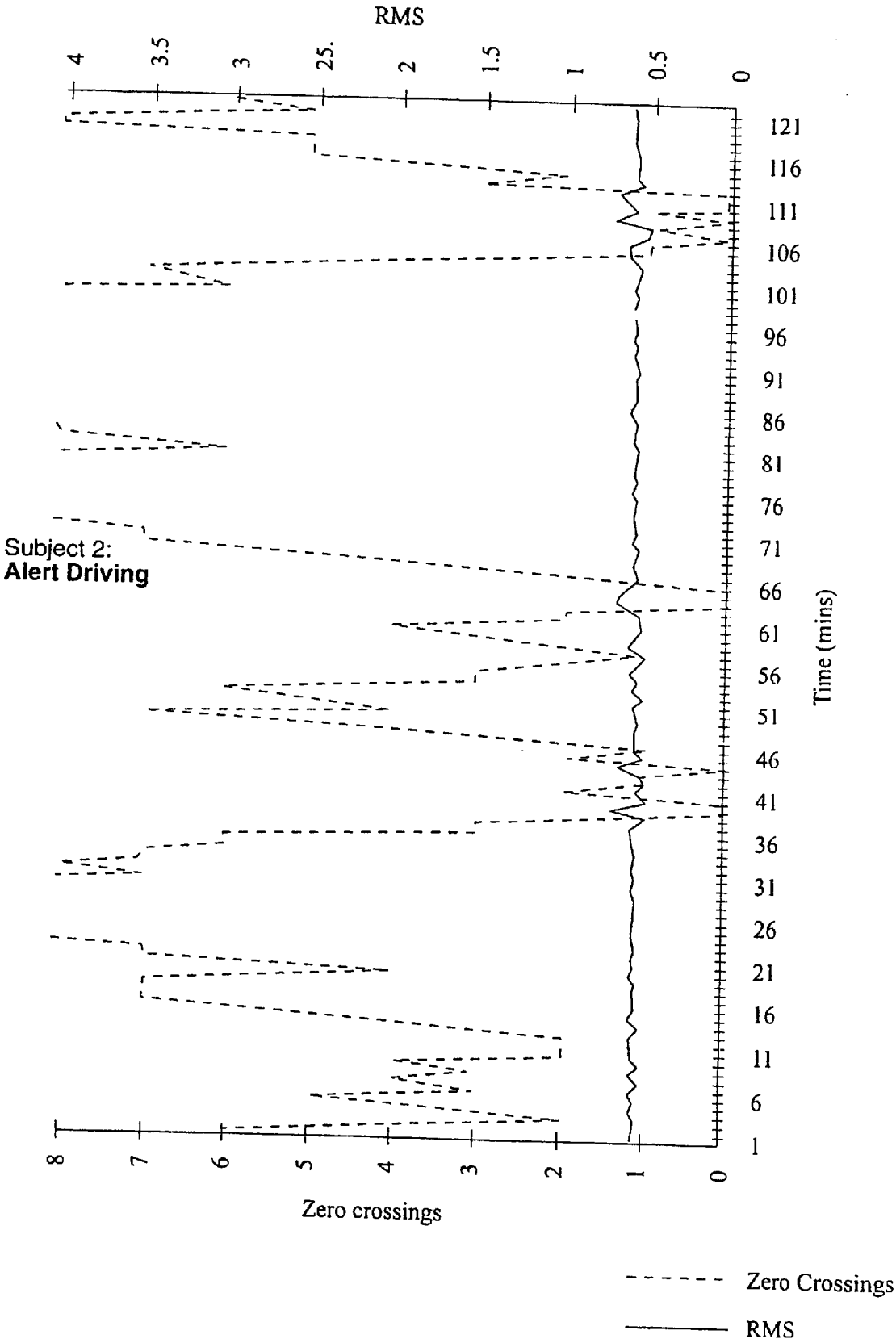
Figure 7:
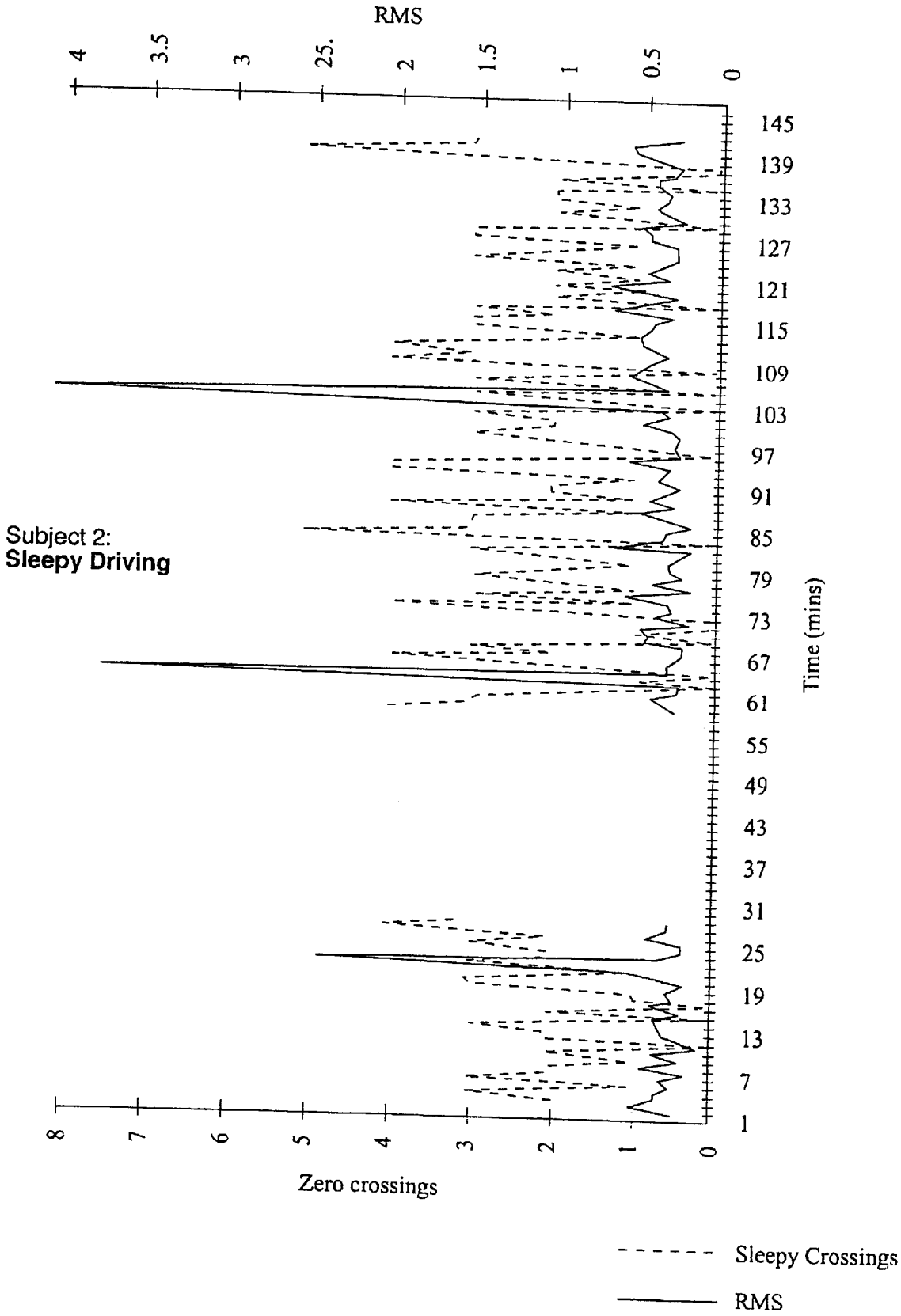

FIG. 6 reflects steering behaviour for another alert subject S2, whilst FIG. 7 shows the corresponding readings when the same subject was sleepy.

Figure 8:
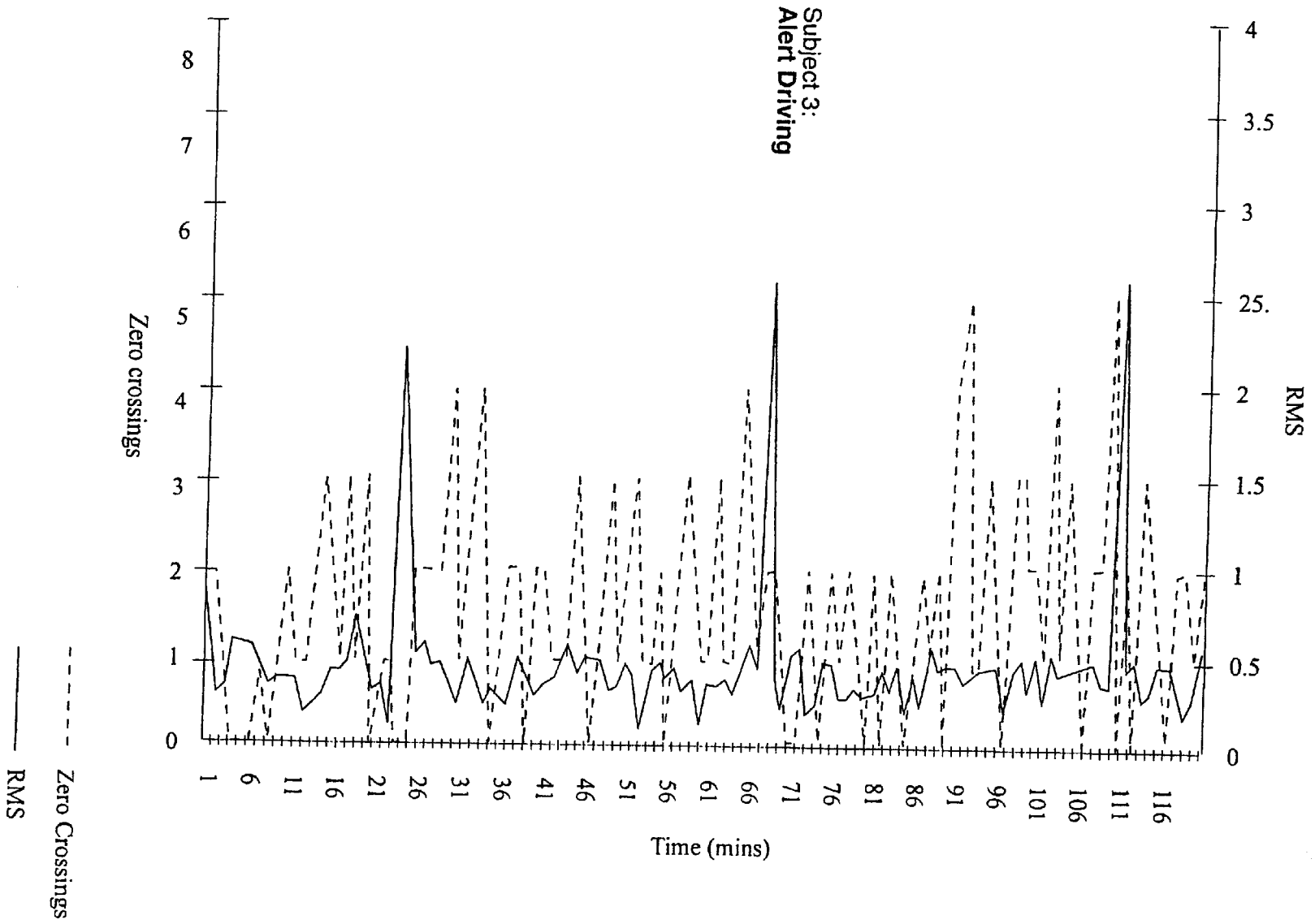
Figure 9:
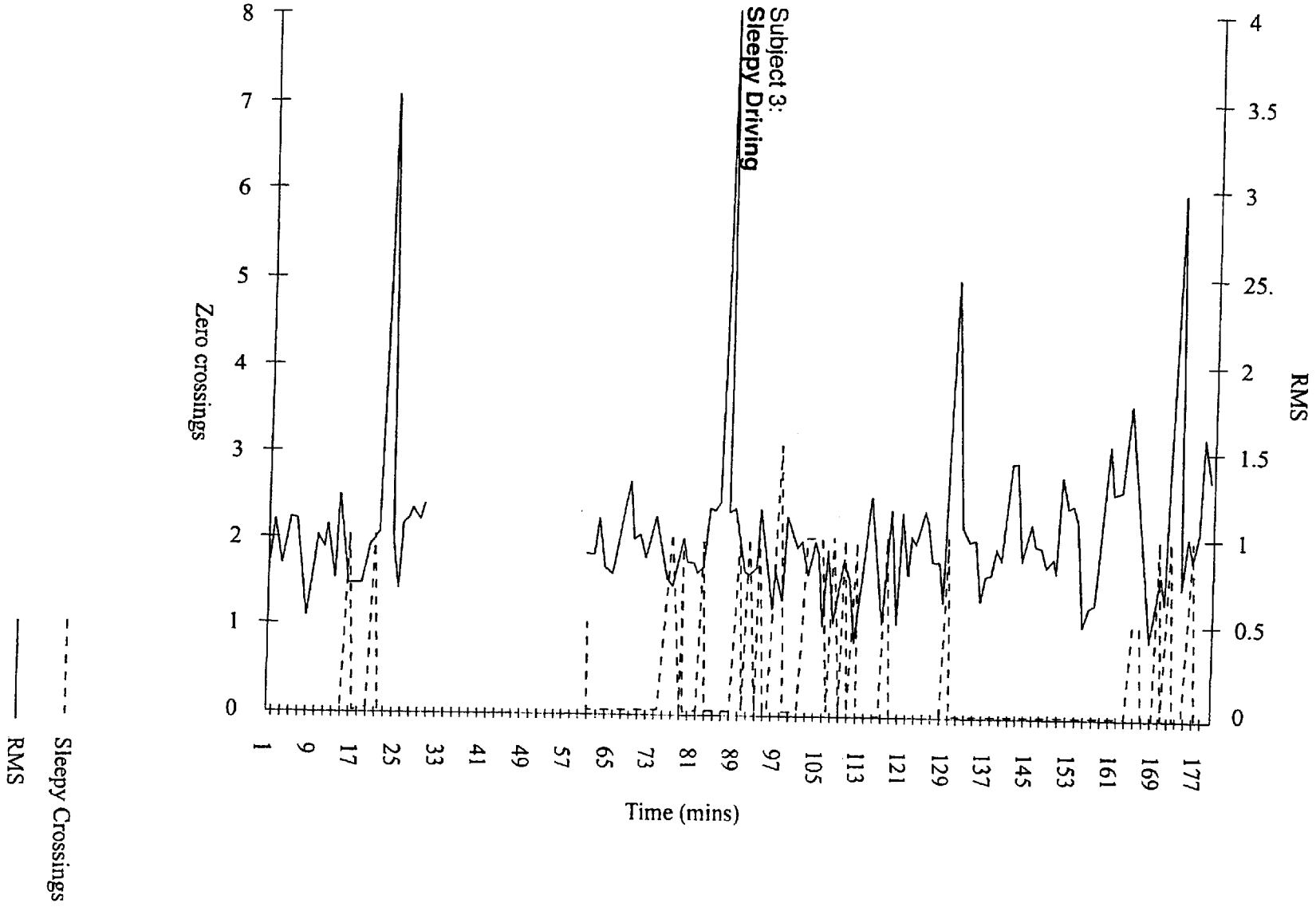

FIG. 8 reflects steering behaviour of yet another alert subject S3 and FIG. 9 that of that subject S3 when sleepy.

Each pair of graphs shows corresponding marked differences in steering behaviour between an alert and sleepy driver.

This characteristic difference validates the use of actual or real-time dynamic steering behaviour to monitor driver sleepiness.

In a practical system, using steering wheel movement to identify sleepiness, on the basis of such findings, it is preferred that, before presenting a sleepiness warning indication, at least two of the following three sleep categorising conditions of steering behaviour are present, namely:

Fewer zero crossings;

RMS amplitude high;

RMS more variable.

RMS averaging may be superseded by other sensing techniques, such as that of the magnetic flux-coupled, inductive sensor of FIG. 20, which can register more directly rate of change of steering wheel movement.

Turning to refinement of practical implementation, FIG. 10 shows a block schematic overall circuit layout or principle elements.

More specifically, the various sensing modes—including vehicle motion (linear acceleration), steering wheel angle, ambient light, temperature, are combined with an audio sounder and mark button in an integrated so-called 'steering wheel adaptor' module 33.

The sensor module 33 is connected through a cable way to an electronic interface 32, which in turn is configured for connection to a personal computer parallel port 39 through a cable link and a mains charger unit 37.

The orientation of the sensor module 33 in relation to reference axes for acceleration and steering wheel angular position are represented in FIGS. 11 and 12.

Angular sensing could be, say, through a variable magnetic flux coupling between magnets set on the steering wheel or column and on adjacent static mounts.

FIGS. 13A through 13D show a master sensor unit 33 with a simplified LED warning indicator array. The detailed circuitry is shown in FIG. 20.

Essentially, the steering sensor measures a change in inductance through an array of some three inductors L1, L2 and L3 through magnetic flux coupling changes caused by movement in relation to the magnetic field of a small magnet 'M' static-mounted upon the steering column—at a convenient, unobtrusive location.

The inductors L1, L2 and L3 are energised by a 32 kHz square wave generated by a local processor clock.

Induced voltage is rectified, smoothed, sampled and measured by the local processor some 16 times per second.

The processor analyses the results digitally to determine the extent of steering wheel movement.

Calibration of the minimum and maximum voltages across each inductor as the magnetic field of the static magnet sweeps across them when the steering wheel is fully turned is undertaken by the local processor, so the mounting location of the static magnet is not overtly critical.

Such inductive sensing is unaffected by road vibration, since both static magnet and inductors are subject to the same vibration and any effect cancelled out.

The local processor feeds sensor data to an executive processor loaded with sleepiness detector algorithms, based upon such factors as circadian rhythm of sleepiness, timing and duration of sleep and ambient light, and which presents an overall indication of driver sleepiness level.

The arrangement is capable of registering and measuring very small angular movements, such as might be encountered in corrective steering action at speed.

FIGS. 14A through 15D relate to wheel movement sensing by a more direct computational technique, involving RMS averaging, compared with the direct rate of change capability of magnetic flux-coupled inductive sensing of the FIG. 20 circuitry.

FIGS. 14A and 14B represent dynamic steering wheel movement sensing.

FIGS. 15A and 15B represent respectively 'raw' and adjusted wheel movements over time.

FIGS. 15C represents a 'zero crossings' count, derived from the adjusted plot of FIG. 15B.

FIG. 15D depicts the 'dead band' range of wheel movement allowed.

FIGS. 16A and 16B respectively, represent 'raw' and corrected plots of vehicle acceleration over time—allowing computation of an RMS average acceleration.

FIG. 17 depicts a characteristic circadian sleepiness rhythm or pattern, with three sleepiness warning threshold levels.

FIG. 18 represents a breakdown of system activity over (T=60 second) operational clock cycles—with a division between monitoring the various sensors over 50 seconds and 10 seconds process time allocation for parameter calculation, test and warning issue, display screen update, sensor data storage of calculated parameters.

FIG. 19 represents data storage array allocation, for monitoring and learning of factors such as vehicle acceleration and wheel movement.

FIG. 21 depicts the flow of information during the memory, operation control input, computational means, and the sleepiness warning indicator.

Hardware considerations aside, an operation software protocol would involve a schema of factors, such as is represented in the Tables below which are generally self-explanatory and will not otherwise be discussed.

Component List

10 (sleepiness) monitor
11 housing
12 steering wheel
13 steering position/movement sensor
14 accelerator pedal
15 accelerator position/movement sensor
16 push-button switch
17 steering wheel spokes
18 display panel/screen
19 interface connector
21 loudspeaker
23 microphone
26 road wheel
27 (drive) shaft sensor
29 photocell sensor
31 temperature probe
33 multi-mode sensor
32 electronic interface
37 mains charger
39 parallel data port

LITERATURE REFERENCES

J. Sleep Research 1994 vol 3 p195; 'Accidents & Sleepiness': consensus of Stockholm International Conference on work hours, sleepiness and accidents.

J. Sleep Research 1995 suppl. 2 p23–29; 'Driver Sleepiness': J. A. Horne & L. A. Reyner British Medical Journal 4 March 1995 vol 310 p565–567; 'Sleep related vehicle accidents': J. A. Horne & L. A. Reyner Int J Legal Med 1998; 'Falling asleep whilst driving: are drivers aware of prior sleepiness?: L. A. Reyner & J. A. Horne

TABLE 1

| |
|---|
| Acc # 1-Vehicle Motion |
| Acc # 2-Wheel Angle |
| Light Sensor - Ambient |
| Temp Sensor - Ambient |
| Sounder |
| Mark Button |

TABLE 2

W - Wheel Rotation Angle
X - Measured component of g in sensor axis (m/s/s)
K wheel - Sensor scaling factor (mm/s/s/bit)
g - Gravity 9.81 m/s/s
g - Gravity Vector Component in wheel Plane
Sin W = X/g
X = k wheel / 1000 × (Ch(1)-ZeroWheel) × 1/Cos(Alpha)
Sin W = k wheel / (1000 × g) × (Ch(1)-ZeroWheel) × (1/Cos(Alpha)
W + ArcSin [Kwheel/(1000 × g) × (Ch(1)-ZeroWheel) × 1/Cos(Alpha)]

TABLE 3

$$\text{RMS Steering Angle} - \text{R(Deg)} = \sqrt{\frac{\Sigma \text{Wheel}[n]^2}{n}}$$

TABLE 4

Bound Check

| | |
|---|---|
| W Limit- < W < W Limit + | Steering Mode = Corrective |
| W < W Limit − | Steering Mode = Active |
| W > W Limit + | Steering Mode = Active |

TABLE 5

$$\text{RMS Vehicle Acceleration} - \text{G(m/s/s)} = \sqrt{\frac{\Sigma \text{Acc}[n]^2}{n}}$$

TABLE 6

| | |
|---|---|
| | Calculate Parameters |
| T cycle = 60 s | Test & Issue Warnings |
| T monitor = 50 s | Update Screen Display |
| T process = 10 s | Store Sensor Data > Disk |
| | Store Calculated Parameters > Disk |

TABLE 7

Note:
Data storage @ 1 Hz
ZeroAcc = Average {RawAcc[n]}
ZeroWheel = Average {RawWheel[n]}
Ch(N) = Raw ADC Value (bit)

TABLE 8

Acc[n] = Kacc/1000 × (RawAcc[n] − ZeroAcc) × 1/Cos(Alpha)
(m/s/s) (mm/s/s/bit) (bit) (bit)
Wheel[n] = ArcSin [Kwheel/(1000 × 9.81) × (RawWheel[n] − Zerowheel) × 1/Cos(Alpha)]
(Deg) (mm/s/s/bit) (bit) (bit)
I = Klight/1000 × (Ch(2) − ZeroLight)
(KLx) (Lx/bit) (bit) (bit)
T = Ktemp/1000 × (Ch(3) − ZeroTemp)
(DegC) (mDegC/bit) (bit) (bit)

TABLE 9

Engineering Scaling Factors

| | |
|---|---|
| K acc (mm/s/s/bit) | Acceleration Channel |
| K wheel (mm/s/s/bit) | Steering Channel |
| K light (Lx/bit) | Light Channel |
| K temp (mDegC/bit) | Temp Channel |
| ZeroLight (bit) | Intercept adjust - Light |
| ZeroTemp (bit) | Intercept adjust - Temp |
| Alpha (Deg) | Steering Wheel Inclination from Vertical |
| Hysterisis (Deg) | Hesterisis factor - Zero X analysis |

TABLE 10

Sleep Propensity Algorithm - Definition
S mod = S circ + S zerox + S rms + S light + S temp + S sleep + S road + S trip

| Elemental | Bound Limit |
|---|---|
| S mod | 0 < S mod < 1 |
| S circ | 0 < S circ < 1 |
| S zerox = (F zerox/100) (Z ref-Z) | 0 < S zerox |
| S rms = (F rms/100) (R-R ref) | 0 < S rms |
| S light = (F light/100) (I ref -I) | 0 < S light |
| S temp = (F temp/100) (T -T ref) | 0 < S temp |
| S sleep = (F sleep/100) (H ref - (HXQ)) | 0 < S sleep |
| S road = (F road/100) (G ref -G) | 0 < S road |
| S trip = (F trip/100) × D | 0 < S trip |

TABLE 11

Algorithm Elementals - S

| | |
|---|---|
| S mod (S) | Modified Sleep Propensity Factor-Range 0 . . . 1 |
| S circ (S) | Current Circadian Sleep Propensity Value |
| S zerox (S) | Current Corrective Steering Reversal Rate Deficit |
| S rms (S) | Current RMS Corrective Steering Amplitude Surfit |
| S light (S) | Current Ambient Lighting Intensity Deficit |
| S temp (S) | Current Ambient Temperature Surfit |
| S sleep (S) | Prior Sleep Good Hours Deficit |
| S road (S) | Current Road Activity Deficit |
| S trip (S) | Accumulated Trip Duration |

TABLE 12

Algorithm Weighting Factors - F
Note: Factors are % S Unit per Parameter Unit

| | |
|---|---|
| F zerox (% S/#/min) | Corrective Steering Reversal Rate Deficit - % Factor |
| F rms (% S/Deg) | RMS Corrective Steering Amplitude Surfit - % Factor |
| F light (% S/kLx) | Average Ambient Lighting Intensity Deficit - % Factor |
| F temp (% S/DegC) | Average Ambient Temperature Surfit - % Factor |
| F sleep (%S/Hr) | Prior to Good Hours Sleep Deficit - % Factor |
| F road (% S/m/s/s) | Road Activity Deficit - % Factor |
| F trip (% S/Hr) | Accumulated Trip Duration - % Factor |

TABLE 13

| Algorithm Reference Offfsets - ref | |
|---|---|
| Z ref (#/min) | Corrective Steering Reversal Rate - Ref Offset |
| | Corresponds to 'Alert' Driving Subject Dependent |
| R ref (Deg) | Corrective Steering RMS Amplitude - Ref Offset |
| | Corresponds to 'Alert' Driving Subject Dependent |
| I ref (kLx) | Average Ambient Lighting Intensity - Ref Offset |
| | Corresponds to moderate daylight |
| T ref (DegC) | Average Ambient Temperature - Ref Offset |
| | Corresponds to moderate environment |
| H ref (Hr) | Prior to Good Hours Sleep - Ref Offset |
| | Corresponds to optimum value |
| G ref (m/s/s) | Road Activity - RMS Acceleration/Deceleration - Ref Offset |

TABLE 14

| Algorithm Dynamic Variables | |
|---|---|
| Z (#/min) | Current Corrective Steering Zero X Rate |
| R (Deg) | Current RMS Corrective Steering Amplitude |
| I (kLx) | Current Ambient Lighting Intensity |
| T (DegC) | Current Ambient Temperature |
| G (m/s/s) | Current Road Activity - RMS Acceleration / Deceleration |
| D (Hr) | Accumulated Trip Duration |
| H (Hr) | Actual Hours of Prior Sleep |
| Q (#) | Prior Sleep Quality - Normalised Scale 0 . . . 1 |
| Qx (#) | Prior Sleep Quality |
| | User Scale 1, 2, 3, 4, 5 |
| | Q = Qx/5 |

TABLE 15

| Steering Mode & Steering Limit -W limit | |
|---|---|
| W limit (Deg) | Decision limit - Steering mode detection + W limit > W > − W limit >>> Corrective + W limit < W < − W limit >>> Active |
| Steering Mode | Steering mode decision ACTIVE, CORRECTIVE |

TABLE 16

| Alarm Levels & Alarm State | |
|---|---|
| Alarm Level 1 (s) | Alarm level threshold |
| Alarm Level 2 (s) | Alarm level threshold |
| Alarm Level 3 (s) | Alarm level threshold |
| Alarm Holdoff (min) | Initial alarm forced hold-off time - N minutes |
| Alarm State | Alarm status decision CLEAR, LEVEL1, LEVEL2, LEVEL3, HOLDOFF |

TABLE 17

| User Software Functions Set Display Parameters | |
|---|---|
| Enter New Values and <RET> or <RET> to bypass edit option. | |
| Display History (min) | Graphic display history length - Last N minutes |
| FSD (S) | Graphic display full scale - S unit (0 . . . 1) |

TABLE 18

| Data Directory Structure |
|---|
| [ALGO]*.ALG |
| Algorithm Data Files - Internal Format |
| [USER]*.ALG |
| User Data Files - Internal Format |
| [XALGO]*.CSV |
| Algorithm Data Files - CSV Format |
| [XUSER]*.CSV |
| User Data Files - CSV Format |
| [XDRIVE]*.CSV |
| Drive Mode Data Files - CSV Format |
| [XLEARN]*.CSV |
| Learn Mode Data Files - CSV Format |

TABLE 19

| File Structure - Program Internal Format<br>Note : These files in program internal readable format | |
|---|---|
| Configuration File - SLEEPALT.CFG | |
| Save Set Values @ Program Shut Down | |
| Load Set Value @ Program Initalisation | |
| K acc | (mm/s/s/bit) |
| K wheel | (mm/s/s/bit) |
| K light | (Lx/bit) |
| K temp | (mDegC/bit) |
| K batt | (mV/bit) |
| ZeroLight | (bit) |
| ZeroTemp | (bit) |
| Hysterysis | (Deg) |
| Alpha | (Deg) |
| AlgorithmID | |
| UserID | |
| Circ[0] . . . [23] | (S) |
| FSD | (0 . . . 1) |
| DisplayHist | (min) |

TABLE 20

| Algorithm Data File [ALGO]*.ALG | |
|---|---|
| F zerox | (% S/#/min) |
| F rms | (% S/Deg) |
| F light | (% S/Klx) |
| F temp | (% S/DegC) |
| F sleep | (% S/Hr) |
| F road | (% S/m/s/s) |
| F trip | (% s/Hr) |
| Z ref | (#/min) |
| R ref | (Deg) |
| I ref | (KLx) |
| T ref | (DegC) |
| H ref | (Hr) |
| G ref | (m/s/s) |
| Alarm1 | (s) |
| Alarm2 | (s) |
| Alarm3 | (s) |
| AlarmHoldoff (min) | |
| W limit (Deg) | |

TABLE 21

| User Data File [USER]*.USR |
|---|
| UserName |
| UserDoB |
| UserSex |

TABLE 22

| Data File Structure - Drive Mode Data File [XDRIVE]*.CSV<br>Note: These files in external readable format - CSV | |
|---|---|
| DriveID | |
| File Ceation Date | |
| Start Time (Hr 0 . . . 23) | |
| Start Time (min 0 . . . 59) | |
| UserID | |
| AlgorithmID | |
| Alarm1 (s) | |
| Alarm2 (s) | |
| Alarm3 (s) | |
| AlarmHoldOff (min) | |
| W limit (Deg) | |
| H (Hr) | |
| Q (0 . . . 1) | |
| F zerox (% S/#/min) | |
| F rms (% S/Deg) | Z (#/min) |
| F light (% S/kLx) | R (Deg) |
| F temp (% S/DegC) | I (KLx) |
| F sleep (% S/Hr) | T (DegC) |
| F road (% S/m/s/s) | G (m/s/s) |
| F trip (% S/Hr) | D (Hr) |
| Z ref (#/min) | |
| R ref (Deg) | S mod (S) |
| I ref (Kix) | S circ(S) |
| T ref (DegC) | S zerox (S) |
| H ref (Hr) | S rms (S) |
| G ref (m/s/s) | S temp (S) |
| Minute Count (min) . . . Repeat 1 . . . N(min) | S sleep (S) |
| AlarmState | S road (S) |
| SteeringMode | S trip (S) |
| Acceleration [1](m/s/s) Wheel[1](Deg) | |
| | DQC (Data Quality Code 0 . . . 255) |
| Acceleration [50] Wheel[50] | |

TABLE 23

| Data File Structure - Learn Mode Data File [XLEARN]*.CSV<br>Note : These files in external readable format - CSV<br>Data File Structure - User Data File [XUSER]*.CSV<br>Note : These files in external readable format - CSV |
|---|
| UserID |
| File Creation Date |
| UserName |
| UserDoB |
| UserSex |

TABLE 24

| Data File Structure - Algorithm Data File [XALGO]*.CSV<br>Note : These files in external readable format - CSV |
|---|
| Algorithm ID |
| File Creation Date |
| F zerox (% S/#/min) |
| F rms (% S/Deg) |
| F light (% S/kLx) |
| F temp (% S/DegC) |
| F sleep (% S/Hr) |
| F road (% S/m/s/s) |
| F trip (% S/Hr) |
| Z ref (#/min) |
| R ref (Deg) |
| I ref (KLx) |
| T ref (DegC) |
| H ref (Hr) |
| G ref (m/s/s) |

TABLE 24-continued

| Data File Structure - Algorithm Data File [XALGO]*.CSV<br>Note : These files in external readable format - CSV |
|---|
| Alarm1 (s) |
| AIarm2 (s) |
| Alarm3 (s) |
| AlarmHoldOff (min) |
| W limit (Deg) |

What is claimed is:

1. A sleepiness monitor for a vehicle driver, or machine operator, comprising:

a sensor for sensing a driver or operator control input;

a memory for storing an operational model that includes a physiological reference model of driver or operator circadian rhythm pattern(s) and a vehicle or machine operating model or algorithm;

computational means for weighting the operational model according to time of day in relation to the driver or operator circadian rhythm pattern(s) and for deriving, from the weighted model, driver or operator sleepiness condition and producing an output determined thereby; and a warning indicator triggered by the computational means output, to provide a warning indicator of driver or operator sleepiness.

2. The sleepiness monitor as claimed in claim 1, including a driver personal data entry interface, for entry of driver sleep pattern, age, sex, and recent alcohol consumption.

3. The sleepiness monitor as claimed in claim 1, including provision, by way of switches, for input of responses to predetermined questions upon driver or operator condition, including recent sleep history.

4. The sleepiness monitor as claimed in claim 1, wherein the sensor comprises a magnetic flux coupled, inductive sensor for rate of change of vehicle or machine steerage.

5. The sleepiness monitor as claimed in claim 1, including a further sensor for vehicle acceleration and/or speed.

6. The sleepiness monitor as claimed in claim 1, including a further sensor for vehicle cab temperature.

7. The sleepiness monitor as claimed in claim 1, including a further sensor for ambient light.

8. A vehicle or machine incorporating a sleepiness monitor as claimed in claim 1.

9. A sleepiness monitor for a driver and vehicle, comprising:

a sensor for sensing a steering movement, about a reference position;

a memory, for storing a circadian rhythm pattern or time-of-day physiological reference profile of predisposition to sleepiness; and computational means for computing steering transitions and weighing that computation according to time of day, to provide a warning indication of driver sleepiness.

* * * * *

US006313749C1

(12) EX PARTE REEXAMINATION CERTIFICATE (9604th)

United States Patent

Horne et al.

(10) Number: US 6,313,749 C1

(45) Certificate Issued: Apr. 19, 2013

(54) SLEEPINESS DETECTION FOR VEHICLE DRIVER OR MACHINE OPERATOR

(75) Inventors: James Anthony Horne, Loughborough (GB); Louise Ann Reyner, Loughborough (GB)

(73) Assignee: Iborme ith IP LLC, Longview, TX (US)

Reexamination Request:
No. 90/012,230, Apr. 2, 2012

Reexamination Certificate for:

| | |
|---|---|
| Patent No.: | **6,313,749** |
| Issued: | **Nov. 6, 2001** |
| Appl. No.: | **09/341,093** |
| Filed: | **Aug. 24, 1999** |

(21) Appl. No.: 90/012,230

(22) PCT Filed: Jan. 5, 1998

(86) PCT No.: PCT/GB98/00015

§ 371 (c)(1), (2), (4) Date: Aug. 24, 1999

(87) PCT Pub. No.: WO98/29847

PCT Pub. Date: Jul. 9, 1998

(30) Foreign Application Priority Data

Jan. 4, 1997 (GB) ..... 9700090

(51) Int. Cl.
*G08B 21/06* (2006.01)

(52) U.S. Cl.
USPC ..... 340/575; 340/576

(58) Field of Classification Search ..... None
See application file for complete search history.

(56) References Cited

To view the complete listing of prior art documents cited during the proceeding for Reexamination Control Number 90/012,230, please refer to the USPTO's public Patent Application Information Retrieval (PAIR) system under the Display References tab.

*Primary Examiner* — Matthew Heneghan

(57) ABSTRACT

A vehicle driver or machine operator sleepiness monitor, configured as a self-contained module, for steering wheel or dashboard mounting, provides for individual driver/operator interrogation and response, combined with various objective sensory inputs on vehicle condition and driver control action, and translates these inputs into weighing factors to adjust a biological activity circadian rhythm reference model, in turn to provide an audio-visual sleepiness warning indication.

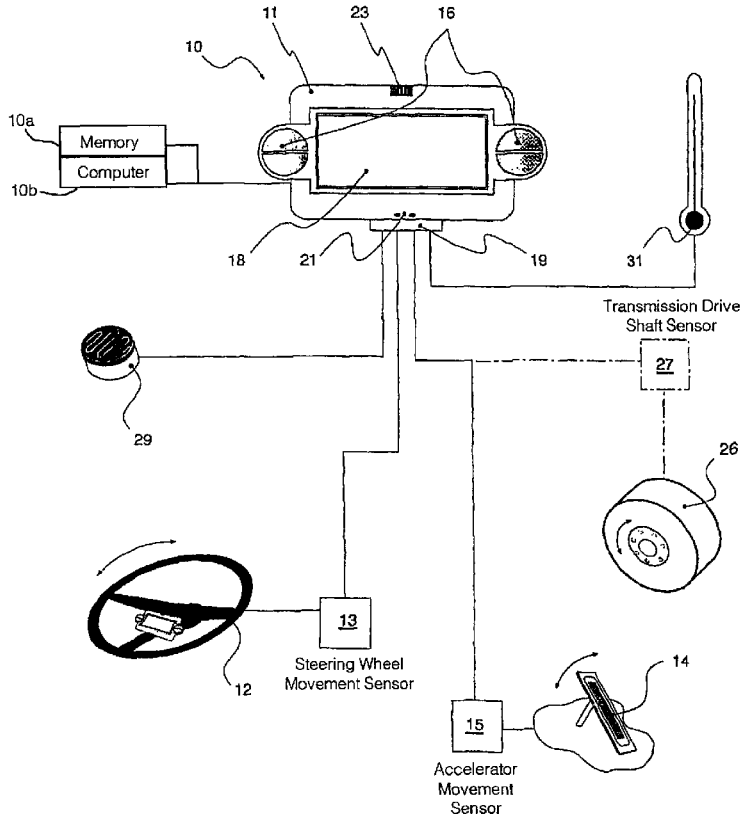

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1-9 is confirmed.

New claims 10-11 are added and determined to be patentable.

*10. A sleepiness monitor for a vehicle driver, or machine operator, comprising:*

*a sensor for sensing a driver or operator control input, wherein said sensor is for sensing steering transitions about a reference position;*

*a memory for storing an operational model that includes a pre-loaded physiological reference model of driver or operator circadian rhythm pattern(s) and a vehicle or machine operating model or algorithm;*

*an internal microprocessor specially programmed to incorporate said sensed steering transitions into said vehicle or machine operating model or algorithm and to weight said operational model according to time of day in relation to the driver or operator circadian rhythm pattern(s), derive, from the weighted model, a driver or operator sleepiness condition and produce an output determined thereby; and*

*a warning indicator, triggered by the processor output, to provide a warning indication of driver or operator sleepiness, wherein said warning indicator includes a visual warning shown on or through a display screen.*

*11. A sleepiness monitor for a vehicle driver, or machine operator, comprising:*

*a sensor for sensing a driver or operator control input, wherein said sensor is for sensing steering transitions from alert to sleepy steering behavior;*

*a monitor for measuring trip duration;*

*a memory for storing an operational model that includes a pre-loaded physiological reference model of driver or operator circadian rhythm pattern(s) and a vehicle or machine operating model or algorithm;*

*an internal microprocessor specially programmed to incorporate said sensed steering transitions and trip duration measurement into said vehicle or machine operating model or algorithm and to weight said operational model according to time of day in relation to the driver or operator circadian rhythm pattern(s), derive, from the weighted model, a driver or operator sleepiness condition and produce an output determined thereby; and*

*a warning indicator, triggered by the processor output, to provide a warning indication of driver or operator sleepiness, wherein said warning indicator includes a visual warning shown on or through a display screen.*

* * * * *